US005426830A

United States Patent [19]

Richardson et al.

[11] Patent Number: 5,426,830

[45] Date of Patent: Jun. 27, 1995

[54] AXIAL ASSEMBLY OF MULTI-PART SLIDER ON ZIPPER

[75] Inventors: Dale S. Richardson, Westerville; Roger W. Smith, Grove City, both of Ohio

[73] Assignee: Mobil Oil Corporation, Fairfax, Va.

[21] Appl. No.: 74,578

[22] Filed: Jun. 10, 1993

[51] Int. Cl.[6] ..... A44B 19/16

[52] U.S. Cl. ..... 24/430; 24/399

[58] Field of Search ..... 24/400, 399, 430; 383/64

[56] References Cited

U.S. PATENT DOCUMENTS

| | | | |
|---|---|---|---|
| 1,898,216 | 2/1933 | Schade et al. | 24/430 |
| 1,923,262 | 8/1933 | Goebel | 24/430 |
| 5,007,142 | 4/1991 | Herrington | 24/400 |
| 5,007,143 | 4/1991 | Herrington | 24/400 |
| 5,020,194 | 6/1991 | Herrington et al. | 24/400 |

FOREIGN PATENT DOCUMENTS

| | | | |
|---|---|---|---|
| 1012988 | 12/1965 | United Kingdom | 24/400 |

*Primary Examiner*—James R. Brittain

*Attorney, Agent, or Firm*—Alexander J. McKillop; Malcolm D. Keen; Gene L. Wise

[57] ABSTRACT

A method of assembling a multi-part plastic slider as a unit with a plastic reclosable fastener on plastic-film bags is disclosed. The multi-part plastic slider includes a support member with a separator finger depending therefrom and two sidewalls joined to the support members by sliding joints on the opposite edges of the support member so that the support member and sidewalls may be partially assembled into a unit which unit is then assembled with the zipper by sliding movement of the sidewalls axially on the sliding joints on the opposite edges of the support member to bring the slider into fully assembled condition.

1 Claim, 3 Drawing Sheets

AXIAL ASSEMBLY OF MULTI-PART SLIDER ON ZIPPER

BACKGROUND OF THE INVENTION

The present invention relates to improvements in plastic sliders for opening and closing plastic reclosable fasteners or zippers on plastic bags and the like and the method of assembling a multi-part plastic slider as a unit with a profiled plastic reclosable fastener on the plastic bags.

Plastic zippers with plastic sliders are well known in the art. The type of plastic zippers to which the present invention relates have profiles that include a pair of male and female fastener elements in the form of reclosable interlocking rib and groove elements with a slider for opening and closing the rib and groove elements. In the manufacture of plastic-film bags, a pair of these male and female fastener elements extend along the mouth of the bag and these male and female elements are adapted to be secured in any suitable manner to the flexible walls of the plastic-film bags.

The sliders for opening or closing the reclosable fasteners are essentially U-shaped and are adapted to be assembled with the zipper by threading them onto the end of the zipper or by a relative transverse maneuver. To facilitate the transverse maneuver, some of the sliders have been provided with folding sidewalls and others have been assembled on the zipper from multiple parts. In some instances, the multiple parts of the plastic slider have been ultrasonically welded together and in other instances the multiple parts of the slider have been constructed to be snapped together. However, in each of these prior art multi-part plastic sliders the various parts have been assembled together in a direction transverse to the axis of the zipper. Examples of patents showing multi-part plastic sliders are shown in U.S. Pat. No. 5,007,142—Herrington, U.S. Pat. No. 5,007,143—Herrington and U.S. Pat. No. 5,020,194—Herrington et al.

It would be desirable to partially assemble the multi-part plastic slider into an assembly of partially joined parts for assembly as a unit with the zipper in a transverse direction.

SUMMARY OF THE INVENTION

It is an object of the present invention to provide an improved multi-part plastic slider assembly and method of assembling the same with a profiled plastic reclosable fastener without interfering with or deforming the fastener during transverse assembly of the slider therewith.

In accordance with the present invention there is provided a multi-part plastic slider for assembly with a profiled plastic reclosable fastener of the type having interlocking profile elements particularly suited for plastic-film bags for opening and closing the fastener. The slider comprises a support member having one wider end and a separator finger depending therefrom and two sidewalls joined to the support member by sliding joints on the opposite edges of the support member. The sidewalls have inwardly extending shoulders at the lower edges of the sidewalls and the sliding joints on the opposite edges of the support member and on the upper edges of the sidewalls have mating rib and groove structure constructed and arranged for sliding movement of the sidewalls axially on the sliding joints on the opposite edges of the support member to a predetermined position wherein the shoulders at the lower edges of the sidewalls are spaced apart a distance adequate so that the slider can be installed transversely over the profile elements of the fastener without interference and wherein thereafter the sidewalls are movable axially with respect to the support member to the fully engaged position of the mating rib and groove structures.

Further in accordance with the invention there is provided a method of assembly of a multi-part plastic slider with a profiled plastic reclosable fastener comprising flanged interlocking profile elements particularly suited for plastic-film bags for opening and closing the fastener, the slider comprising a support member having one wider end and a separator finger depending therefrom and two sidewalls to be joined to the support member by sliding joints on the opposite edges of the support member, the sidewalls having inwardly extending shoulders at the lower edges of the sidewalls. The method comprises the step of partially assembling the sidewalls onto the wider end of the support member by sliding the sidewalls axially on the sliding joints on the opposite edges of the support member to a predetermined position where the shoulders at the lower edges of the sidewalls are spaced apart a distance adequate so that the slider can be installed transversely over the profile elements without interference. The method further includes the step of installing the slider transversely onto the profile elements as an assembly of partially-joined parts with a separator finger positioned between the flanges of the profiled elements. The method also includes the step of thereafter moving the sidewalls axially with respect to the support member to the fully engaged positions of the sliding joints whereby the shoulders on the sidewalls extend beneath the profile elements to prevent removal of the slider from the reclosable fastener.

In accordance with one aspect of the invention there is provided a method of assembly of a multi-part plastic slider into an assembly of partially joined parts for assembly as a unit with a profiled plastic reclosable fastener comprising flanged interlocking profile elements particularly suited for plastic-film bags for opening and closing the fastener, the slider comprising a support member having one wider end and a separator finger depending therefrom and two sidewalls to be joined to the support member by sliding joints on the opposite edges of the support member, the sidewalls having inwardly extending shoulders at the lower edges of the sidewalls. The method comprises the steps of partially assembling the sidewalls onto the wider end of the support member and sliding the sidewalls axially on the sliding joints on the opposite edges of the support member to a predetermined position wherein the shoulders at the lower edges of the sidewalls are spaced apart a distance adequate so that the slider can be installed as a partially assembled unit transversely over the profile elements without interference.

Other objects and advantages of the invention will become apparent from the following detailed description of the invention taken in conjunction with the accompanying drawings.

PREFERRED EMBODIMENT OF THE INVENTION

Figure 1:
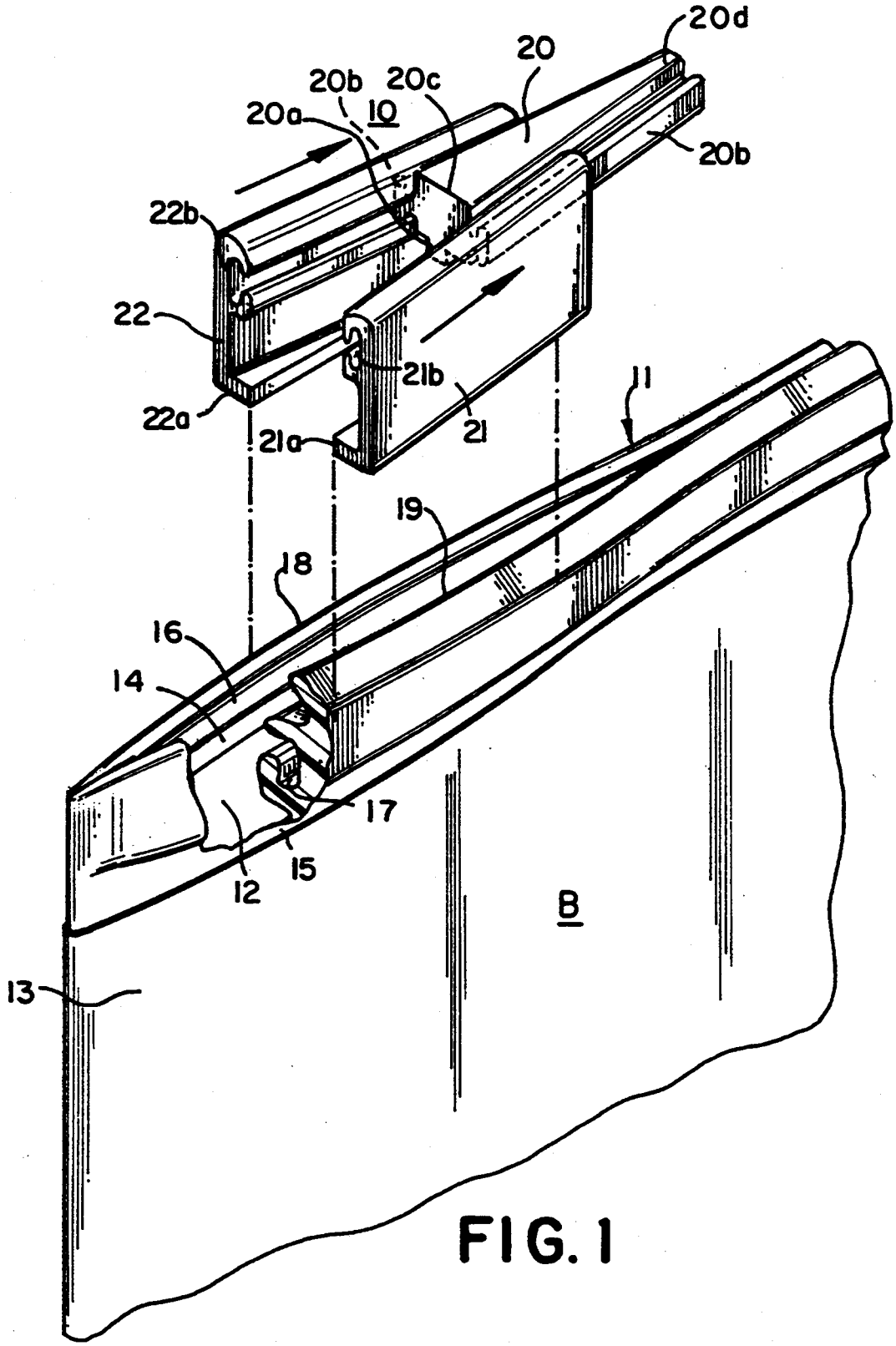
FIG. 1 is a perspective view of a plastic-film bag or the like showing a multi-part plastic slider assembled into an assembly of partially joined parts preparatory for assembly as a unit with a profiled plastic reclosable fastener at the top edge of the bag in accordance with the method embodying the present invention.
Figure 3:
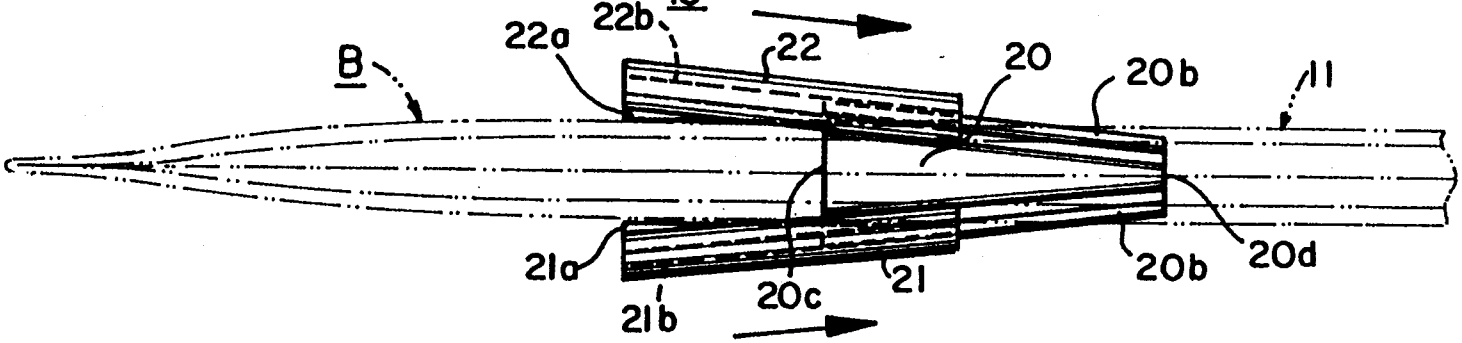
FIG. 3 is a top view of the partially assembled multi-part plastic slider illustrated in FIG. 1 with the profiled plastic reclosable fastener shown in phantom lines.

Referring to FIGS. 1 and 3 there is illustrated a partially assembled multi-part plastic slider 10 for a profiled plastic reclosable fastener or zipper embodying the present invention. The slider 10 is particularly suited for plastic-film bags and the like and has been illustrated in FIG. 1 in connection with a plastic zipper 11 on a plastic-film bag B. The zipper 11 is mounted on the top edge or mouth of the plastic-film bag. The bag B may be made of any suitable plastic-film including for example polyethylene or polypropylene or similar material. The bag B, FIG. 1, is formed by a pair of flexible plastic sheets 12 and 13. The zipper 11 extends along the top edge of the bag and comprises a pair of flexible plastic strips 14 and 15 having separable plastic means extending along the length thereof comprising interlocking male and female profile elements in the form of rib and groove elements 16 and 17 on the respective strips. The strips 14 and 15 may be extruded separately and attached to the respective sides of the bag mouth or the strips 14 and 15 may be extruded integral with the sides of the bag mouth. The strips 14 and 15 may include flanges 18 and 19 extending along the length thereof parallel to the rib and groove elements 16 and 17. The zipper 11 may be of any suitable design. One suitable type is disclosed in U.S. Pat. No. 5,007,143 wherein the rib and groove elements 16 and 17 have complementary cross-sectional shapes such that they are closed by pressing the bottom of the elements together first and then rolling the elements to the closed position toward the top thereof.

Figure 2:
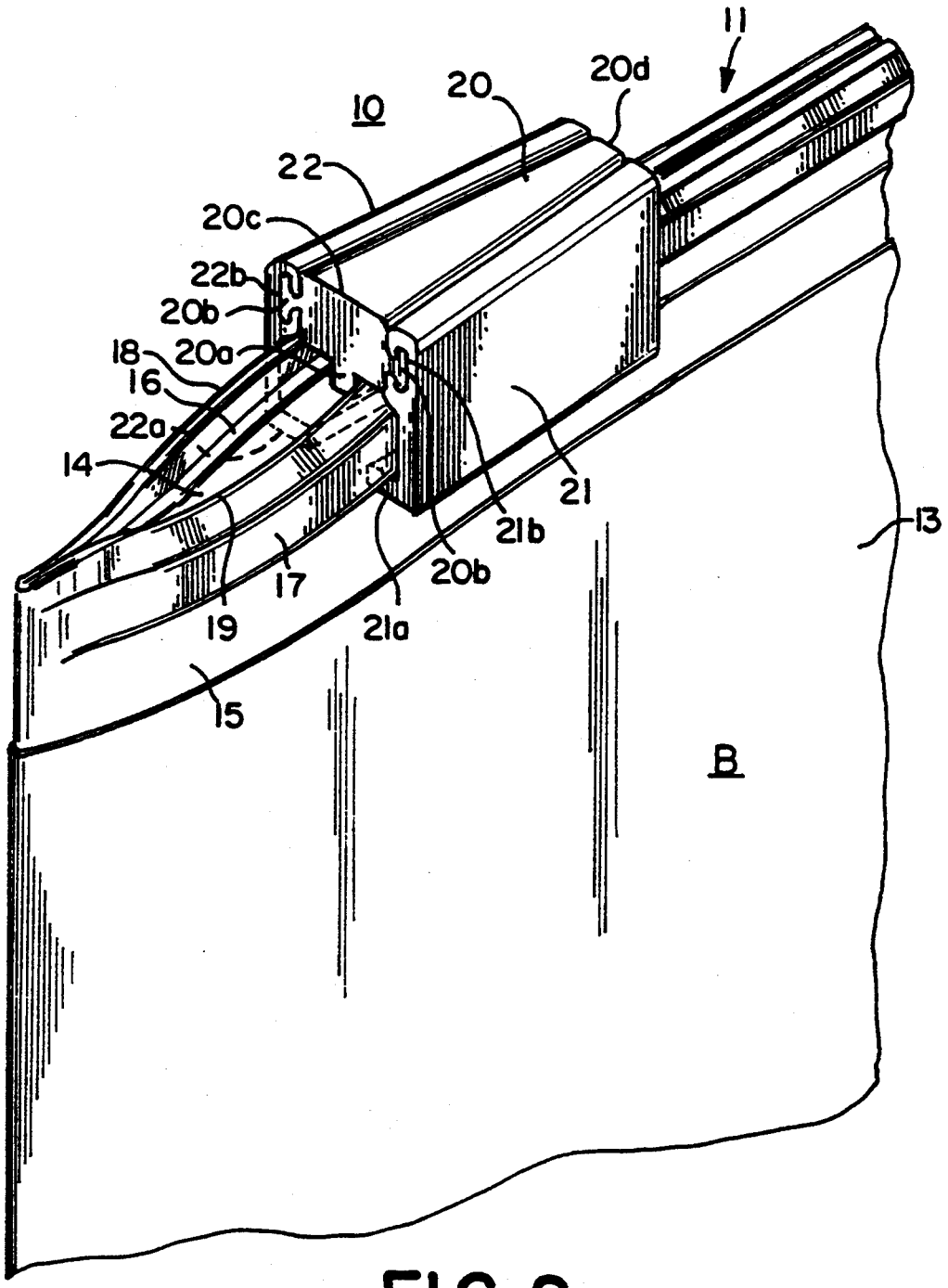
FIG. 2 is a perspective view similar to FIG. 1 showing the multi-part plastic slider completely assembled on the profiled plastic reclosable fastener.

The novel slider 10 is formed from multiple plastic parts comprising a plastic support member 20 having a separator finger **20*a* depending therefrom and two sidewalls 21 and 22 joined to the support member 20 by sliding joints on the opposite edges of the support member. The sidewalls 21 and 22 have inwardly extending shoulders 21*a* and 22*a* at the lower edges of the respective sidewalls. The sliding joints on the opposite edges of the support member 20 and the upper edges of the sidewalls 21 and 22 have mating rib and groove structures 20*b*, 20*b* and 21*b* and 22*b*. As may be seen in FIGS. 1 and 2 the ribs 20*b*, 20*b* on the support member 20 mate respectively with the grooves 21*b* and 22*b* on the sidewalls 21 and 22. It will be noted that one end 20*c* of the support member 20 is wider than the other end 20*d*. The shoulders 21*a* and 22*a* at the lower ends of the sidewalls 21 and 22 are also wider at that end of the slider and taper to a narrower width at the opposite end corresponding to the end 20*d* of the support member. With this construction, when the sidewalls 21 and 22 are assembled on the support member 20 into the position shown in FIG. 1, the spacing between the edges of the shoulders 21*a* and 22*a* as indicated by the vertical phantom lines in FIG. 1 is such that the slider 10 can be assembled transversely onto the upper edge of the zipper 11. The support member 20 will then rest on the top edges of the flanges or tracks 18 and 19 with the separator finger 20*a* positioned therebetween as shown in FIG. 2**.

Figure 4:
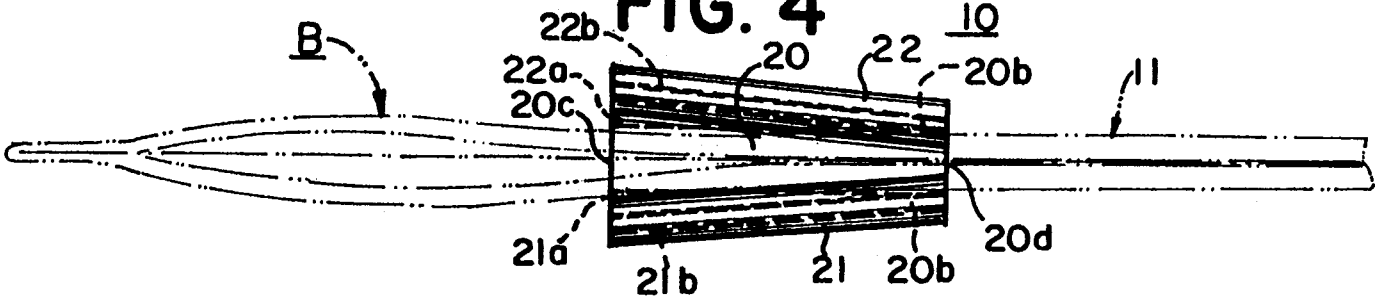
FIG. 4 is a top view of the completely assembled multi-part plastic slider shown in FIG. 2 with the profiled plastic reclosable fastener shown in phantom lines.

From the foregoing it will be seen that the mating rib and groove structures **20*b*, 21*b* and 20*b*, 22*b* on the support member 20 and sidewalls 21, 22 are constructed and arranged for sliding movement of the sidewalls 21, 22 axially on the sliding joint on the opposite edges of the support member 20 to a predetermined position as shown in FIG. 1 wherein the shoulders 21*a*, 22*a* at the lower edges of the sidewalls 21, 22 are spaced apart a distance adequate so that the slider 10 can be installed transversely over the interlocking profiled elements of the zipper 11 without interference. After the slider 10 has been placed on top of the zipper 11 with the separator finger between the flanges or tracks 18, 19, the sidewalls 21 and 22 are moved axially with respect to the support member 20 as shown by the arrows in FIG. 1 to the fully engaged positions of the sliding joints as shown in FIGS. 2 and 4. In this assembled position the shoulders 21*a* and 22*a* on the sidewalls 21, 22 extend beneath the profile elements 16, 17 to prevent removal of the slider 10 from the reclosable fastener 11. This assembled position of the slider 10 is best seen in FIG. 2**.

The various parts of the plastic slider 10 may be molded from any suitable thermoset or thermoplastic materials including nylon, polypropylene, polystyrene, Delrin and ABS. A multi-part plastic slider of the present invention has an advantage over prior art multi-part plastic sliders in that the parts can be partially assembled into a unit and then such unit is assembled fully with the zipper. This eliminates the necessity of dealing with a multiplicity of parts during the assembly as disclosed in the aforementioned U.S. Pat. No. 5,007,142.

While a preferred embodiment of the invention has been described and illustrated, it is to be understood that further modifications thereof may be made within the scope of the appended claims without departing from the spirit of the invention.

What is claimed is:

1. A multi-part plastic slider for assembly with a profiled plastic reclosable fastener of the type having flanged interlocking profile elements particularly suited for plastic-film bags for opening and closing the fastener, the slider comprising a support member having one wider end and a separator finger depending therefrom and two sidewalls joined to the support member by sliding joints on the opposite edges of the support member, the sidewalls having inwardly extending shoulders at the lower edges of the sidewalls, said sliding joints on the opposite edges of the support member and the upper edges of the sidewalls having mating rib and groove structures constructed and arranged for sliding movement of the sidewalls axially on the sliding joints on the opposite edges of the support member to a predetermined position wherein the shoulders at the lower edges of the sidewalls are spaced apart a distance adequate so that the slider can be installed transversely over the profile elements of the fastener without interference and where thereafter the sidewalls are movable axially with respect to the support member to the fully engaged position of the mating rib and groove structures in which position the shoulders at the lower edges of the sidewalls are positioned beneath the profile elements of the fastener and thus prevent removal of the slider from the reclosable fastener.

* * * * *